US008336241B2

(12) United States Patent
Rowland et al.

(10) Patent No.: US 8,336,241 B2
(45) Date of Patent: Dec. 25, 2012

(54) DEVICE FOR DISPLAYING A GRAPHIC HOLDER

(75) Inventors: Simon John Rowland, Wigston (GB); Helen Johns, Bedford (GB)

(73) Assignee: Display Mode Limited, Northampton (GB)

( * ) Notice: Subject to any disclaimer, the term of this patent is extended or adjusted under 35 U.S.C. 154(b) by 465 days.

(21) Appl. No.: 12/721,295

(22) Filed: Mar. 10, 2010

(65) Prior Publication Data

US 2011/0219655 A1 Sep. 15, 2011

(51) Int. Cl.
*G09F 3/20* (2006.01)

(52) U.S. Cl. ..... 40/649; 40/642.01; 40/661.05

(58) Field of Classification Search ..... 40/642.01; 211/57.1, 54.1, 59.1; 248/224.7, 225.21
See application file for complete search history.

(56) References Cited

U.S. PATENT DOCUMENTS

| | | | | |
|---|---|---|---|---|
| 2,141,342 | A | 12/1938 | Brownell | |
| 5,231,779 | A * | 8/1993 | Valiulis et al. | 40/649 |
| 7,513,074 | B2 * | 4/2009 | Glenn et al. | 40/649 |

FOREIGN PATENT DOCUMENTS

| | | | |
|---|---|---|---|
| EP | 0919980 | A1 | 6/1999 |
| GB | 1220674 | A | 1/1971 |
| GB | 2458543 | A | 9/2009 |
| JP | 10016462 | A | 1/1998 |
| JP | 2001008800 | | 1/2001 |
| WO | WO 93/10516 | A1 | 5/1993 |
| WO | WO 2006/056629 | A1 | 6/2006 |
| WO | WO 2008/077971 | A | 7/2008 |

* cited by examiner

*Primary Examiner* — Casandra Davis
(74) *Attorney, Agent, or Firm* — Etherton Law Group, LLC; Benjamin D. Tietgen; Sandra L. Etherton

(57) ABSTRACT

The present invention provides a device for mounting a graphic holder on a display arm. The device has a body portion substantially formed of a resilient elastic material. The body portion comprises a band for securing around a display arm. As the band is resilient and elastic it can be used to mount the device on a variety of different shaped display arms. The device further comprises a neck portion attached to the body portion at a first end and having attaching means for holding the graphics holder substantially at a second end. The present invention also provides a system for displaying a graphic on a display arm comprising a device and a graphic holder.

35 Claims, 4 Drawing Sheets

DEVICE FOR DISPLAYING A GRAPHIC HOLDER

FIELD OF INVENTION

The present invention relates to the display of graphic holders on display arms in commercial premises, for example the display of price signs on clothing rails. In particular, the present invention provides an improved device for positioning a graphic holder on a display arm.

BACKGROUND

Many goods are displayed in shops on display arms. Typically, the goods will be hung below a display arm. This is beneficial allows a plurality of goods to be displayed on a shop floor in a relatively compact space. Most display arms comprise stop means positioned at the end of the display arm to prevent goods from sliding off the arm. Typically, display arms have a suitable stop means formed at or near the end of the display arm. Generally the stop means comprises a protrusion is formed on, and extends upwards from, an upper surface of the display arm. For example, some display arms have a small ball welded on an upper surface adjacent to the end of the display arm to act as a stop means whilst other display arms have plates that extend above the upper surface of the arm attached to the end of the arm to act as a stop means.

In order to inform customers about the goods displayed on the display arm information regarding the goods may be positioned substantially at an end of the display arm. The information may include the price of the goods, information on sales offers or specific information on the specification of the goods. The information is usually in the form of a suitably sized graphic i.e. a piece of paper or card with the information printed on one side. The graphic may or may not be held in a graphic holder. A typical graphic colder comprises a rigid plastic sleeve for the graphic.

It is important that any graphic or graphic holder positioned on the end of a displaying arm does not become an obstacle to a person easily placing goods on and removing goods from the display arm. It is also important that the graphic or graphic holder is not easily damaged by the placement and removal of goods on or from the display arm. Therefore, many graphics are displayed in hinged graphics holders. Typically, the graphic holder is attached to the display arm at a top edge by a hinge. This allows the graphic holder to swing about a horizontal axis that is perpendicular to the display arm. Generally, when goods are not being placed on, or taken from, the display arm the graphic holder will hang in a substantially vertical position. However, as the graphic holder is hinged, it is able to swing away from the vertical position when required. For example, the graphic holder can be swung upwards, away from the display arm, when removing goods from the arm. Nevertheless, graphic holders formed in this manner do impede the placing and removal of goods on or from a display arm. Furthermore, graphic holders formed in this manner are typically formed of hard plastics and are prone to breakages and may even injure customers.

Therefore, there is a need for an improved device for displaying graphics and graphic holders on display arms. The new device should allow graphics to be displayed on a display arm without interfering with the operation of the display arm. The new device should also be resistant to breakages and should definitely not provide any possibility of injuring a user.

SUMMARY OF INVENTION

The present invention provides a device for positioning a graphic holder on a display arm comprising:

a body portion substantially formed of a resilient elastic material and comprising a band for securing around a display arm; and a neck portion attached to the body portion at a first end and having attaching means for holding the graphics holder substantially at a second end.

The present invention is advantageous over the prior art as it allows a graphic holder to be safely displayed on a display arm whilst preventing damage to the graphic holder and preventing users from being injured. The present invention also facilitates the placing of goods on the display arm and the removal of goods from the display arm. In particular, the present invention provides a flexible fixing solution for displaying graphics holders.

As the body portion of the device is formed of a resilient elastic material it can be fitted to device arms with a large range of cross sections. That is, a single device can be used to mount a graphic holder on any one of a large variety of differently shaped display arms. All that is necessary is that the size of the band of the device is suitable for the cross-sectional size of the display arm. For example, the same device could be used to mount a graphic holder on a display arm with a substantially circular cross-section or on a display arm with a substantially rectangular cross-section of approximately the same size.

Preferably the band of the body portion of the device will be formed as a continuous stretchable band. This means the band does not have opening or a closure but is instead positioned on a display arm by stretching the band around the arm. However, it is to be understood that a device according to the present invention may have a band that is not continuous and has a closure means. Devices formed in this manner may be attached to a display arm by opening the closure means of the band, placing the band in position around a display arm and then fixing the band in position around the display arm using the closure means.

Preferably the device of the present invention comprises locating means for fixing the orientation of the body portion in relation to the display arm. A location means is beneficial as it allows the device to remain in a specific orientation in relation to the display arm. For example the first end of the neck portion can be substantially at an upper side of a display arm.

A locating means may be formed in substantially any manner apparent to a person skilled in the art. In a preferred embodiment of the invention the locating means comprises an aperture formed through a wall of the band. A locating means formed in this manner operates by positioning the stop means of a display arm through the aperture when the device is positioned on the display arm. This prevents the band of the device rotating relative to the display arm and prevents the device being moved along the display arm.

In order to facilitate the positioning of a device according to the present invention on a display arm it may be preferable that the body portion additionally comprises a holdable tab extending from outwards from the band. The tab may be formed integrally with the band and may be formed substantially opposite a stop means of the device.

A device according to the present invention may be formed in any manner apparent to the person skilled in the art. However, it may be advantageous that the device is substantially formed as a unitary moulded product. That is, the device may be formed as a single moulding using an appropriate manufacturing process, such as injection moulding.

If a device according to the present invention is formed as a unitary moulded product it may be preferable that it is formed of a silicone material. Silicones are advantageous for forming the present invention as they are relatively resilient and elastic. Furthermore, silicones are a relatively cheap material.

The attaching means of the present invention may comprise any means suitable for attaching a graphic holder to a device in such a manner that the graphic holder is suitably supported by the device.

The attaching means of the device may comprise an attaching aperture formed through the second end of the neck portion. An attaching aperture can be utilised to support a graphic holder by positioning a cooperatively formed attaching portion of the graphic holder through the attaching aperture of the device. For example, a graphic holder may have a suitably sized protrusion formed on a rear wall. By removably fixing the protrusion of the graphic holder in the attaching aperture of the device the graphic holder may be removably attached thereto. If the attaching means of the device is an attaching aperture it may be formed substantially centrally through the aperture. Additionally or alternatively, an inner side of the end wall may have a cut away portion that is formed around the aperture and extends through approximately half of the thickness of end wall to enable location of an attaching means of the graphic holder therein.

Alternatively, the attaching means of a device according to the present invention may comprise a locating tab formed substantially at the second end of the neck portion. A locating tab can be utilised to support a graphic holder by positioning the locating tab through a cooperatively formed locating slot or aperture formed in a wall of the graphic holder. For example, a graphic holder may have a suitably sized locating slot formed through a rear wall. By permanently or removably positioning the locating tab of the device through the locating slot of the graphic holder the graphic holder may be permanently or removably attached thereto.

An inner surface of a locating tab may be attached to an outer surface of the end wall of the device by a joining portion. The joining portion may be attached to the end wall just below an upper edge of the end wall. The locating tab may extend from just above the joining portion to below a lower edge of the end wall. Furthermore, the locating tab may have a thickened portion formed across a front surface. The thickened portion may be located opposite a joining portion and may be a reinforcement thereof. The locating tab may have a plurality of parallel ridges are formed on an outer wall thereof to enable the tab to be grasped by a user. The parallel ridges may be formed below and be parallel to any thickened portion of the tab.

Preferably, the neck portion of a device according to the present invention substantially comprises a first side wall attached to a first side of the body portion at a first end, a second side wall attached to a second side of the body portion at a first end and an end portion attached to a second end of the first side wall and a second end of the second side wall thereby substantially forming the second end of the neck portion. Although the neck portion of the device of the present invention may alternatively be formed as a single solid portion or a single planar wall it is preferable that the neck portion is substantially formed of first side wall, a second side wall and an end wall, as set out above. This is because a neck portion formed in this manner is relatively lightweight but resilient. In particular, a neck portion formed of two substantially parallel side walls will be more resistant to twisting than a neck portion formed of a single wall. The presence of an end wall attached to the first and second side walls further reinforces the neck portion in a lightweight manner.

If the neck portion has a first side wall and a second side wall they may have reinforcing portions substantially at each of their edges. The reinforcing portions may be portions of increased thickness substantially extending along, or adjacent to, the edges of the side walls from their first end to their second end. Reinforcing portions are advantageous as they strengthen the side walls in a lightweight and simple manner. Suitably formed reinforcing portions can prevent excessive stretching or twisting of the neck portion.

Advantageously, if a neck portion of a device according to the present invention is formed of a first side wall, a second side wall and an end wall the first side wall and the second side wall may be substantially parallel and extend in a plane parallel to an axis of the band of the body portion and the end portion of the neck portion may be substantially perpendicular to the axis of the band of the body portion. For example, the first side wall and the second side wall may extend vertically upwards from the body portion of the device in a plane parallel to one another and parallel to the axis of the band of the body portion, the first and second side walls may bend through approximately ninety degrees such that their second ends, and the end wall, are substantially vertical and in a plane perpendicular to the axis of the body portion. This arrangement is advantageous as it means that the end wall is substantially vertical and may be positioned directly above an opening of the band of the body portion of the device. This enables a graphic holder to be attached to the end wall of the device and be supported in a substantially vertical position adjacent to an end of a display arm when the device is positioned on the display arm, adjacent to its end.

Furthermore, this method of locating the end wall is preferable as it means that is difficult to rotate a top edge of the end wall downwards, towards an opening of the band of the device. This is due to the difficulty in stretching the first and second side walls in this direction. In contrast, it is relatively easy to rotate the top edge of the end wall upwards, towards a top side of the band of the device, as the first and second side walls can be compressed in this direction. As will be readily appreciated, in practice, this allows a graphic holder attached to the end wall of the device to be lifted upwards fairly easily whilst preventing the downward rotation of the graphic holder, where it might impact an end of a display arm or the goods displayed thereon.

In order to facilitate the rotation of the device and an attached graphic holder, as set out in the paragraph immediately above, it is advantageous that an edge of the end portion extending between the first side wall and the second side wall is substantially adjacent to the band of the body portion and is separated from the body portion by a notch. The notch may either comprise a zone of reduced thickness or a gap formed between the edge of the end portion and the body portion. The presence of this notch makes the rotation of a top edge of the end wall back towards a top side of the band of the device easier as it means it is not necessary to stretch a relatively thick portion of material that might otherwise be present between an edge of the end portion and the body portion.

The present invention also provides a system for the display of graphic on display arms comprising a device according to the discussion above and a graphic holder. The graphic holder may be any graphic holder that is suitable for use with a device as set out above. In an embodiment of the system of the present invention the graphic holder comprises a substantially rigid polymer sleeve for containing a graphic, the sleeve being open at an upper edge for inserting or removing a graphic and having attaching means for attaching to the attaching means of the device. However, it is to be appreciated that many other conventional graphic holders are known and these could be easily adapted to operate with the device of the present invention and such suitably adapted graphic holders may be part of a system according to the present invention.

As set out above, a graphic holder for operation with the device of the present invention requires attaching means for attaching the graphic holder to the device. The attaching means of the graphic holder must be suitable for cooperatively attaching to the attaching means of the device.

In an embodiment of the system of the present invention attaching means of the graphic holder is substantially comprised of a slot formed in a rear wall of the graphic holder.

In an alternative embodiment of the system of the present invention the attaching means of the graphic holder is substantially comprised of a rotatable shaft extending outwards from a rear wall of the graphic holder. For example, the attaching means of a graphic holder may be mounted through an aperture formed in a wall of the graphic holder. The attaching means may comprise a central axle with stop means formed at each end of the axle. A first stop means may be mounted at a first end of the axle, within a space of the graphic holder, and a second stop means may be mounted at a second end of the axle, outside of the graphic holder. In this manner the attaching means is rotatably mounted within the graphic holder. The attaching means may be used to attach the graphic holder to a device by positioning the axle of the attaching means through an attaching aperture of the device such that the second stop means is positioned on an opposing side of the end wall from the graphic holder.

Further features, details and advantages of the present invention will be apparent from the preferred embodiments that are illustrated in the Figures and are described below.

DRAWINGS

DETAILED DESCRIPTION OF THE INVENTION

Figure 1:
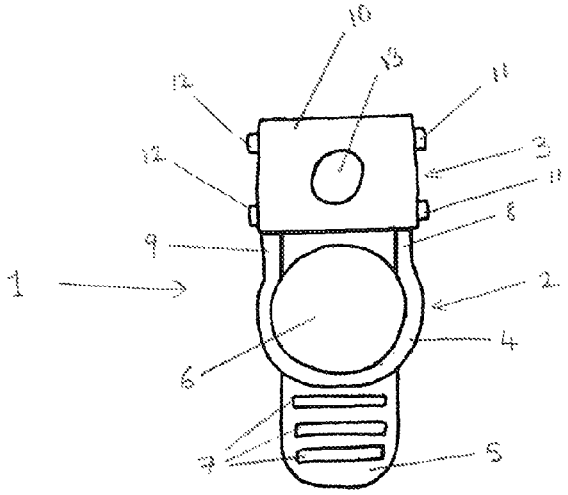
FIG. 1 is front view of a first embodiment of a device according to the present invention.
Figure 4:
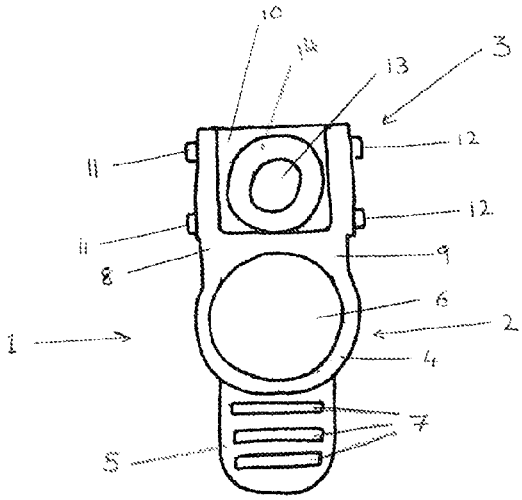
FIG. 4 is a rear view of the first embodiment of the device.
Figure 2:
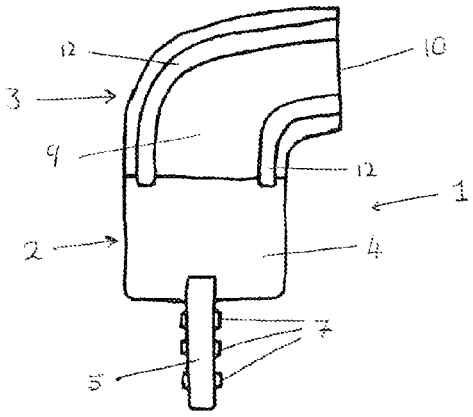
FIG. 2 is a first side view of the first embodiment of the device.
Figure 5:
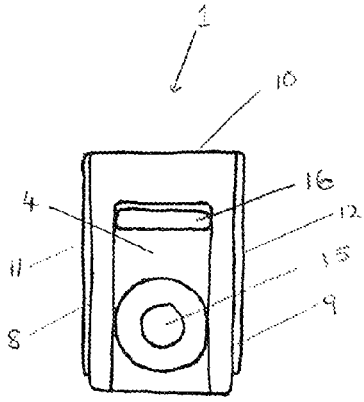
FIG. 5 is a top view of the first embodiment of the device.
Figure 3:
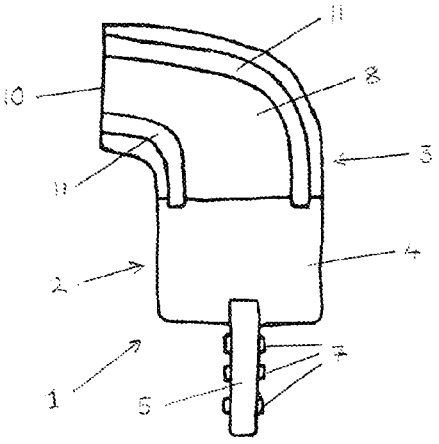
FIG. 3 is a second side view of the first embodiment of the device.
Figure 6:
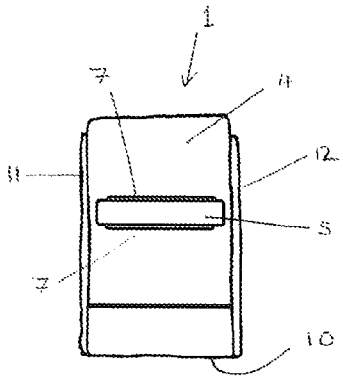
FIG. 6 is a bottom of the first embodiment of the device.
Figure 7:
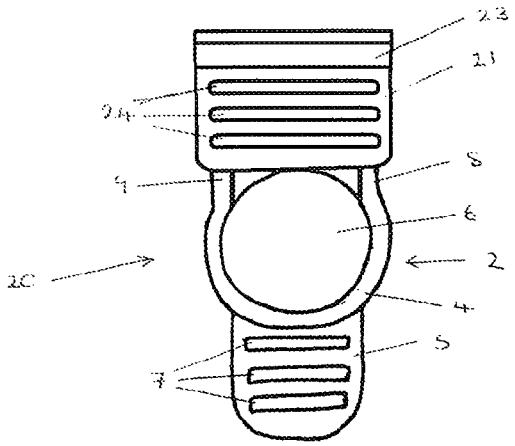
FIG. 7 is front view of a second embodiment of a device according to the present invention.
Figure 10:
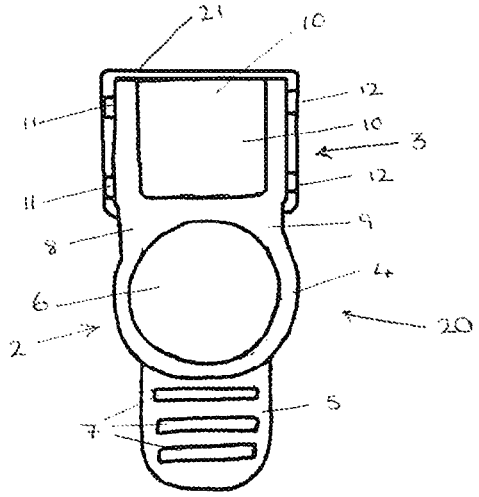
FIG. 10 is a rear view of the second embodiment of the device.
Figure 8:
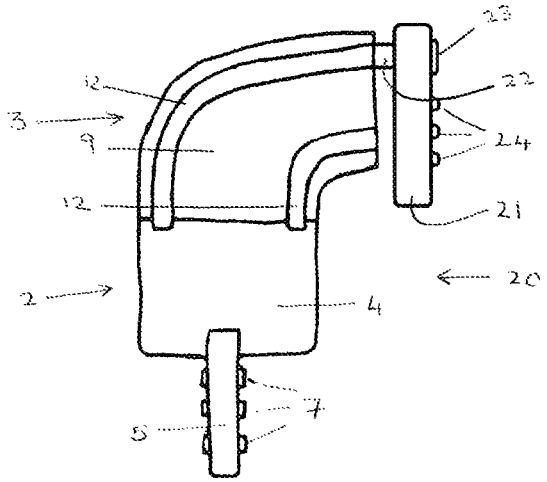
FIG. 8 is a first side view of the second embodiment of the device.
Figure 11:
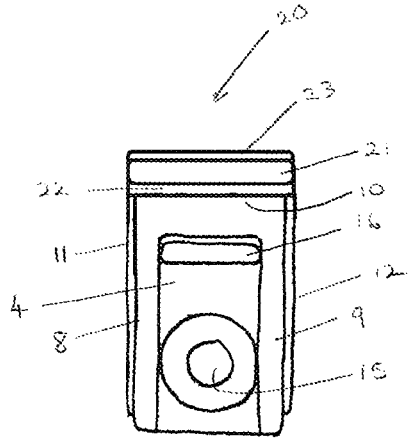
FIG. 11 is a top view of the second embodiment of the device.
Figure 9:
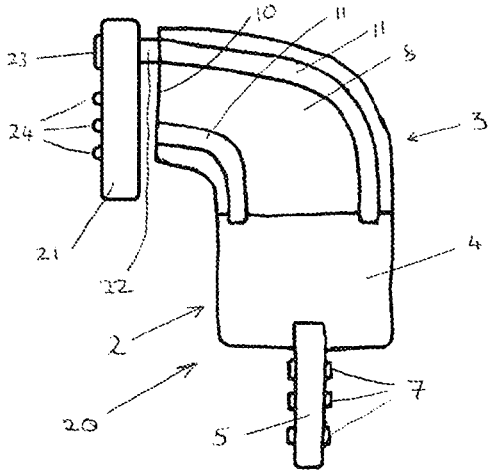
FIG. 9 is a second side view of the second embodiment of the device.
Figure 12:
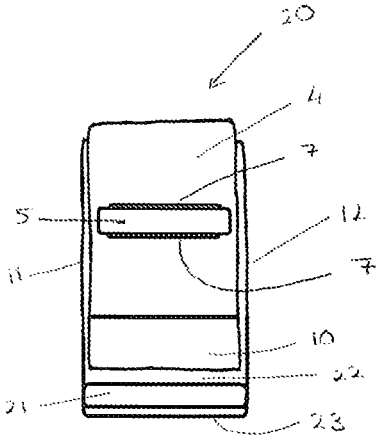
FIG. 12 is a bottom of the second embodiment of the device.

A first embodiment 1 of a device according to the present invention is shown in FIGS. 1 to 6. A second embodiment 20 of a device according to the present invention is shown in FIGS. 7 to 12. The first embodiment 1 and the second embodiment 20 are very similar and have a large number of the same features. Where appropriate, features that are common to both the first embodiment 1 and the second embodiment 20 are indicated by the same reference numerals in the following description.

The first embodiment 1 of the device is formed of a single piece of moulded silicone material. The moulded silicone material is a resilient elastic material that can flex and be stretched in an elastic manner. The device 1 has a body portion 2 and a neck portion 3. The body portion 2 comprises a continuous band 4, a holdable tab 5 and a central aperture 6 around which the band is formed. The holdable tab 5 extends downwards from an outer surface of the lower side of the band 4. The tab 5 is substantially planar and is formed in a plane that is substantially normal to the axis of the central aperture 6. The tab 5 has a plurality of parallel ridges 7 formed on its front and back surfaces that allow the tab to be easily held by a user. The neck portion 3 of the device 1 extends upwards from the upper side of the band 4, substantially opposite the tab 5.

The neck portion 3 comprises a first side wall 8 attached to a first side of the band 4 at a first end, a second side wall 9 attached to a second side of the band 4 at a first end and an end wall 10 attached to a second end of the first side wall 8 and a second end of the second side wall 9. The first side wall 8 has first side wall reinforcing portions 11 formed adjacent to its edges and the second side wall 9 has second wall reinforcing portions 12 formed adjacent its edges. The end wall 10 is formed above the band 4, is substantially planar and is substantially normal to the axis of the central aperture 6. The end wall 10 has an attaching aperture 13 formed centrally therethrough. An inner edge of the end wall 10 extending between the first side wall 8 and the second side wall 9 is adjacent to the band 4 and is separated from the band 4 by a notch 16. The notch 16 comprises a zone of reduced thickness wherein the thickness of the silicone is very much thinner than that of the band 4 or the first side wall 8 or the second side wall 9 or the end wall 10. An inner side of the end wall 10 has a cut away portion 14 that is formed around the aperture 13 and extends through approximately half of the thickness of the end wall. A locating aperture 15 is formed through an upper side of the band 4, between the first side wall 8 and the second side wall 9 and directly above the tab 5.

The second embodiment of the device 20 comprises all of the features of the first embodiment 1 except for the attaching aperture 13 and the cutaway portion 14 formed through the end wall 10. The second embodiment 20 additionally comprises a locating tab 21 that is formed adjacent and parallel to the end wall 10. An inner surface of the locating tab 21 is attached to an outer surface of end wall 10 by a joining portion 22. The joining portion 22 is substantially perpendicular to the first side wall 8, the second side wall 9, the end wall 10 and the locating tab 21. The joining portion 22 is located just below an upper edge of the end wall 10. The locating tab 21 extends from just above the joining portion to below a lower edge of the end wall 10. The locating tab 21 has a thickened portion 23 formed across a front surface. The thickened portion 23 is located opposite the joining portion 22 and is a reinforcement thereof. A plurality of parallel ridges 24 are formed on an outer wall of the locating tab 21 to enable the tab to be grasped by a user. The parallel ridges 24 are formed below and are parallel to the thickened portion 23 of the tab 21.

Figure 15:
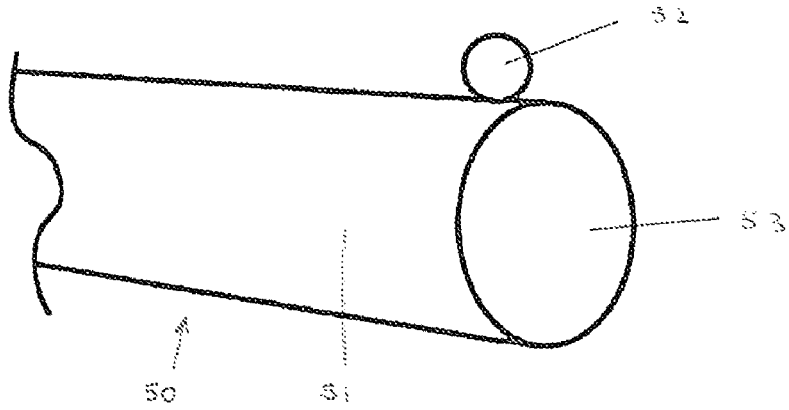
FIG. 15 is a display arm suitable for use with either the first or the second embodiment of the device.

The first and second embodiments of the device 1; 20 can be used to mount a suitable graphic holder 30; 40 on a suitable display arm 50. The end of a suitable display arm 50 is shown in FIG. 15. The display arm 50 substantially consists of a horizontal beam 51 of elliptical cross-section with a stop means 52 mounted on an upper surface adjacent to an outer end 53. The stop means 52 is a spherical ball that is welded to the upper surface of the beam 51.

The first and second embodiments of the device 1, 20 can be mounted on a display arm by stretching the band 4 around the beam 51 of the display arm such that the beam 51 extends through the central aperture 6 of the band 4 and the end wall 10 of the device 1, 20 is facing outwards from the display arm. The stop means 52 is positioned through the locating aperture 15 formed through the upper side of the band 4. In this manner the device 1, 20 can be removably mounted on the display arm 50 and the stop means 52 of the display arm will prevent the device from rotating about the display arm.

Figure 13:
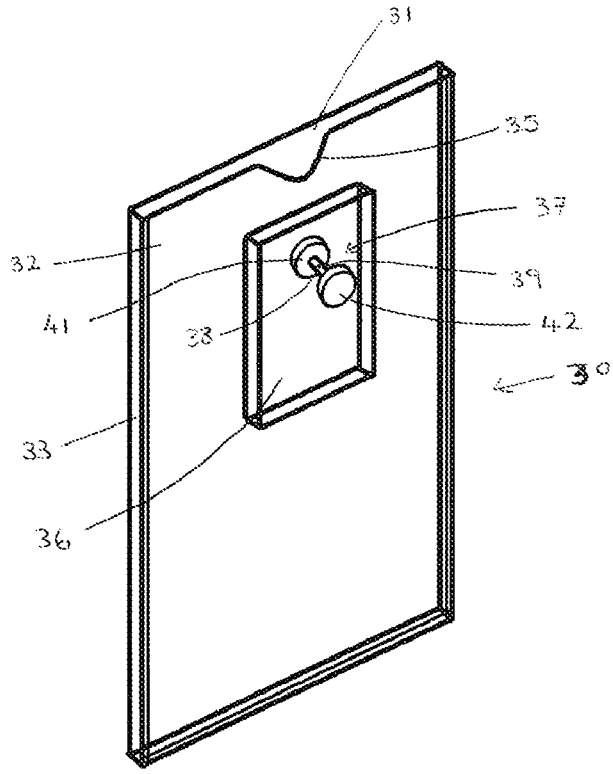
FIG. 13 is a graphic holder that is suitable for use with the first embodiment of the device.
Figure 14:
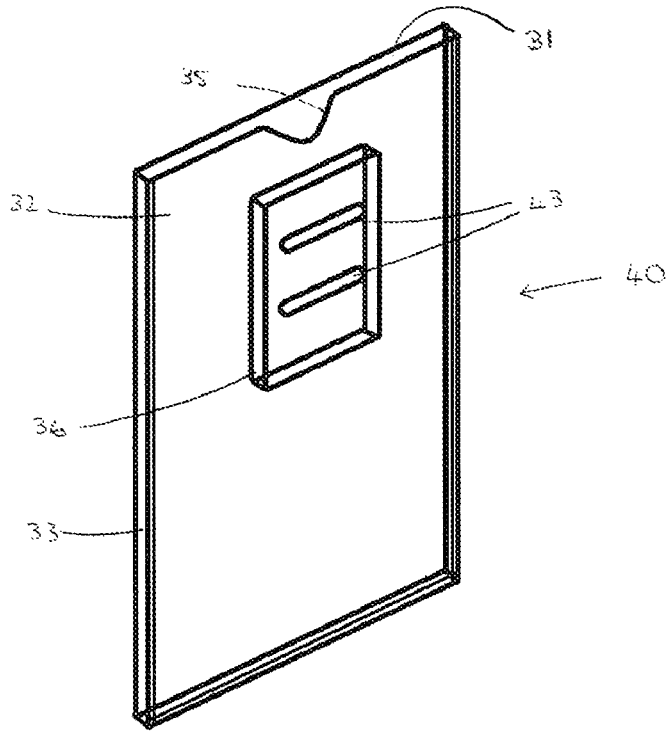
FIG. 14 is a graphic holder that is suitable for use with the second embodiment of the device.

The first embodiment of the device 1 can be used to mount a graphic holder 30 according to FIG. 13 on a display arm 50. The second embodiment of the device 20 can be used to mount a graphic holder 40 according to the FIG. 14 on a display arm 50. The graphic holder 30 of FIG. 13 and the graphic holder 40 of FIG. 14 are very similar and have a large number of the same features. Where appropriate, features that are common to both graphic holders 30, 40 are indicated by the same reference numerals in the following description. The graphic holders 30, 40 are rigid transparent plastic sleeves within which a graphic (not shown) can be mounted. The graphic holders 30, 40 comprise an outer wall 31 and an inner wall 32 that can be semi-permanently or permanently clipped together using fixing means (not shown) formed on side walls 33 of the outer wall 31 and of the inner wall 32 to form a sleeve. The side walls 33 extend around three edges of the outer wall 31 and the inner wall 32. There is no side wall along an upper edge of the outer wall 31 or the inner wall 32 such that when the outer and inner walls are clipped together the upper edge of the resulting sleeve is open. A small cutaway portion 35 is provided in the upper edge of the inner wall 32. The cutaway portion 35 is approximately finger sized and allows a graphic positioned within the holder 30; 40 to be removed therefrom without the need to invert the holder.

An attaching portion 36 is formed at a central upper portion of the inner wall 32. The attaching portion 36 is a rectangular portion of the inner wall 32 that is parallel to the rest of the inner wall but is not coplanar therewith. When the outer wall 31 and the inner wall 32 are joined together the attaching portion 36 is spaced away from the outer wall 31 by a distance greater than the spacing between the rest of the inner wall 32 and the outer wall 31. In this manner the attaching portion 36 forms a cuboid-shaped space within the graphic holder 30; 40.

The graphic holder 30 of FIG. 13 has a rotatable attaching means 37 mounted through an aperture 38 formed centrally in the attaching portion 36. The attaching means 37 comprises a central axle 39 with stop means 41, 42 formed at each end of the axle. A first stop means 41 is mounted at a first end of the axis 39, within the cuboid-shaped space of the graphic holder 30, and a second stop means 42 is mounted at a second end of the axle, outside of the graphic holder. In this manner the attaching means 37 is rotatably mounted in the attaching portion 36 of the graphic holder 30.

The graphic holder 30 of FIG. 13 can be rotatably attached to the first embodiment of the device 1 by pushing the second stop means 42 of the attaching means 37 through the aperture 13 formed in the end wall 10 of the device such that the axle of the attaching means 37 extends through the aperture 13 and the second stop means 42 is substantially located in the cutaway portion 14 formed in the inner wall of the end wall.

The graphic holder 40 of FIG. 14 has two horizontal slots 43 formed centrally in the attaching portion 36. These slots 43 allow the graphic holder 40 to be semi-permanently and non-rotatably mounted on the second embodiment of the device 20. In particular, the graphic holder can be mounted on the device 20 by pulling the locating tab 21 through one of the slots 43 formed in the attaching portion. The parallel ridges 24 formed on the locating tab 21 assist the user in doing this. As will be readily appreciated, this must be done before the outer wall 31 of the graphic holder 40 is clipped to the inner wall 32. The horizontal slots 43 are formed such that they are a similar size and thickness to the joining portion 22 of the device 20 and the device 20 can thereby securely hold the graphic holder 40. As will be understood, the elastic nature of the material from which the device 20 is formed allows the locating tab 21 to be pulled through a horizontal slot 43 despite the fact that the locating tab 21 is slightly larger than the horizontal slot 43. Furthermore, it will also be understood that when the locating tab 21 has been positioned through a horizontal slot 43 of a graphic holder 40 it may be difficult, if not impossible, to remove the graphic holder 40 from the device 20 without damaging one or the other, or both.

The present invention may comprise either a device 1; 20 alone or a system comprising both a device 1; 20 and a cooperating graphic holder 30; 40.

Figure 16:
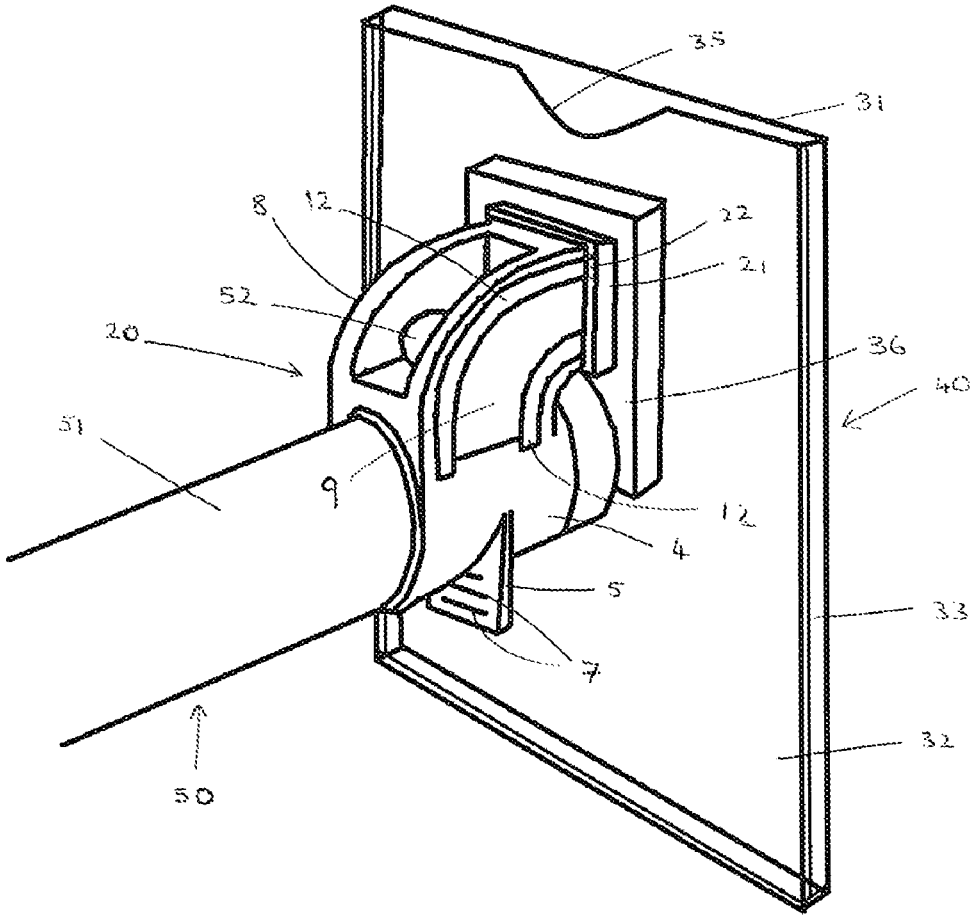
FIG. 16 shows a graphic holder according to FIG. 14 mounted on a display arm using the device of FIGS. 7 to 12.

FIG. 16 shows the second embodiment of the device 20 according to the present invention supporting a cooperating graphic holder 40 on a display arm 50. As can be clearly seen in FIG. 16, the graphic holder 40 is supported in a substantially vertical position adjacent to the outer end 53 of the display arm 50. It can also be seen that the stop means 52 of the display arm 50 is located through the locating aperture 15 in the upper side of the band 4 in order to prevent the device 20 rotating about the display arm.

As will be readily understood by the skilled person, as the device 20 is formed of a silicone material it is possible to rotate the graphic holder 40 upwards by lifting a lower edge of the graphic holder away from the display arm 50. This is useful as it allows goods to be easily placed on and removed from the display arm 50. The majority of the rotation of the graphic holder is facilitated by the device 20 by rotation of the locating tab 21 relative to the end wall 10 by flexion of the joining portion 22. However, the rotation of the graphic holder 40 is further facilitated by the presence of the notch 16 of the device 20. The notch 16 comprised of a zone of reduced thickness that is formed at the inner edge of the end wall 10 adjacent to the band 4. As this notch 16 is a zone of reduced thickness it allows the end wall 10 of the device 20 to be rotated back towards the top surface of the band more easily than would otherwise be possible.

The graphic holder 40 can not be rotated downwards substantially beyond the vertical position shown in FIG. 16. This is because the first side wall reinforcing portions 11 and the second wall reinforcing portions 12 prevent any substantive stretching of the first side wall 8 or the second side wall 9 respectively. If the first side wall and second side wall reinforcing portions 11, 12 were not present it would be possible to rotate the graphic holder 40 downwards. This is undesirable as it would allow the graphic holder 40 to impact the outer end 53 of the display arm 50.

What is claimed is:

1. A device for positioning a graphic holder on a display arm comprising:

a body portion substantially formed of a resilient elastic material and comprising a band for securing around a display arm; and a neck portion attached to the body portion at a first end and having attaching means for holding the graphics holder substantially at a second end; wherein:

the neck portion substantially comprises a first side wall attached to a first side of the body portion at a first end, a second side wall attached to a second side of the body portion at a first end and an end portion attached to a second end of the first side wall and a second end of the second side wall thereby forming the second end of the neck portion;

the first side wall and the second side wall are parallel and extend in a plane parallel to an axis of the band of the body portion and the end portion of the neck portion is substantially perpendicular to the axis of the band of the body portion;

the first side wall and the second side wall have reinforcing portions substantially at each of their edges; and an edge of the end portion extending between the first side wall and the second side wall is substantially adjacent to the band of the body portion and is separated from the body portion by a notch;

the device being a unitary moulded product substantially formed of a silicone material.

2. The device according to claim 1 having locating means for fixing the orientation of the body portion in relation to the display arm.

3. The device according to claim 2 wherein the locating means comprises an aperture formed through a wall of the band.

4. The device according to claim 1 wherein the band is continuous.

5. The device according to claim 4 wherein the body portion additionally comprises a holdable tab extending outwards from the band.

6. The device according to claim 4 wherein the attaching means comprises a locating tab formed at the second end of the neck portion.

7. The device according to claim 1 wherein the body portion additionally comprises a holdable tab extending outwards from the band.

8. The device according to claim 1 wherein the attaching means comprises an attaching aperture formed through the second end of the neck portion.

9. The device according to claim 1 wherein the attaching means comprises a locating tab formed at the second end of the neck portion.

10. The device according to claim 1 wherein the notch comprises a zone of reduced thickness.

11. The device according to claim 10 having locating means for fixing the orientation of the body portion in relation to the display arm.

12. The device according to claim 11 wherein the locating means comprises an aperture formed through a wall of the band.

13. The device according to claim 10 wherein the band is continuous.

14. The device according to claim 10 wherein the body portion additionally comprises a holdable tab extending outwards from the band.

15. The device according to claim 10 wherein the attaching means comprises an attaching aperture formed through the second end of the neck portion.

16. The device according to claim 10 wherein the attaching means comprises a locating tab formed at the second end of the neck portion.

17. The device according to claim 1 wherein the notch comprises a gap formed between the edge of the end portion and the body portion.

18. The device according to claim 17 having locating means for fixing the orientation of the body portion in relation to the display arm.

19. The device according to claim 17 wherein the locating means comprises an aperture formed through a wall of the band.

20. The device according to claim 17 wherein the band is continuous.

21. The device according to claim 17 wherein the body portion additionally comprises a holdable tab extending outwards from the band.

22. The device according to claim 17 wherein the attaching means comprises an attaching aperture formed through the second end of the neck portion.

23. The device according to claim 17 wherein the attaching means comprises a locating tab formed at the second end of the neck portion.

24. A system for the display of a graphic on a display arm, the system comprising:

a graphic holder; and a device for positioning the graphic holder on a display arm, the device comprising:

a body portion substantially formed of a resilient elastic material and comprising a band for securing around a display arm; and a neck portion attached to the body portion at a first end and having attaching means for holding the graphics holder substantially at a second end; wherein the neck portion of the device substantially comprises a first side wall attached to a first side of the body portion at a first end, a second side wall attached to a second side of the body portion at a first end and an end portion attached to a second end of the first side wall and a second end of the second side wall thereby substantially forming the second end of the neck portion;

the first side wall and the second side wall are parallel and extend in a plane parallel to an axis of the band of the body portion and wherein the end portion of the neck portion is substantially perpendicular to the axis of the band of the body portion;

the first side wall and the second side wall have reinforcing portions substantially at each of their edges; and an edge of the end portion extending between the first side wall and the second side wall is substantially adjacent to the band of the body portion and is separated from the body portion by a notch;

the device being a unitary moulded product substantially formed of a silicone material.

25. The system according to claim 24 wherein the graphic holder comprises a substantially rigid polymer sleeve for containing the graphic, the sleeve being open at an upper edge for inserting or removing the graphic and having attaching means for attaching to the attaching means of the device.

26. The system according to claim 25 wherein the attaching means of the graphic holder comprises a slot formed in a rear wall of the graphic holder.

27. The system according to claim 25 wherein the attaching means of the graphic holder comprises a rotatable shaft extending outwards from a rear wall of the graphic holder.

28. The system according to claim 24 wherein the device has locating means for fixing the orientation of the body portion in relation to the display arm.

29. The system according to claim 28 wherein the locating means comprises an aperture formed through a wall of the band.

30. The system according to claim 24 wherein the band of the body portion is continuous.

31. The system according to claim 24 wherein the body portion of the device additionally comprises a holdable tab extending from outwards from the band.

32. The system according to claim 24 wherein the attaching means of the device comprises an attaching aperture formed through the second end of the neck portion.

33. The system according to claim 24 wherein the attaching means of the device comprises a locating tab formed at the second end of the neck portion.

34. The system according to claim 24 wherein the notch comprises a zone of reduced thickness.

35. The system according to claim 24 wherein the notch comprises a gap formed between the edge of the end portion and the body portion.

* * * * *